US005479787A

United States Patent [19]

Carter et al.

[11] Patent Number: 5,479,787

[45] Date of Patent: Jan. 2, 1996

[54] AIR-CONDITIONED BOOTH WITH VENDING UNIT

[75] Inventors: Steven B. Carter, 3217 Quiet Mill Rd., Apt. B-6, Raleigh, N.C. 27612; Thomas A. Mefferd, Murrells Inlet, N.C.

[73] Assignee: Steven B. Carter, Raleigh, N.C.

[21] Appl. No.: 269,751

[22] Filed: Jul. 1, 1994

[51] Int. Cl.[6] ..... F25D 17/08

[52] U.S. Cl. ..... 62/231; 62/407; 454/236

[58] Field of Search ..... 62/231, 407–412; 454/233, 236

[56] References Cited

U.S. PATENT DOCUMENTS

| | | | |
|---|---|---|---|
| 2,184,473 | 12/1939 | Scanlan | 454/236 X |
| 2,293,482 | 8/1942 | Ambrose | 62/408 X |
| 3,529,439 | 9/1970 | Brennan | 62/407 X |
| 3,982,583 | 9/1976 | Shavit | 62/412 X |
| 5,005,636 | 4/1991 | Haessig | 454/236 X |

*Primary Examiner*—William E. Tapolcai
*Attorney, Agent, or Firm*—Rhodes, Coats & Bennett

[57] ABSTRACT

An air-conditioned booth for accommodating a small number of people. The air-conditioned booth includes a transparent wall structure extending from a base to a top and enclosing an interior space. The booth includes a duct system and connected air conditioner for cooling air and directing the cooled air into the interior space of the booth. A damper system is operatively connected with the duct system and is positionable to place the booth in a non-cooling mode and a cooling mode. Air cooled by the air conditioner is directed to the ambient air surrounding the booth by the damper system when the booth is in the non-cooling mode and air cooled by the air conditioner is directed into the interior space of the booth when the booth is in the cooling mode. A vending unit is operatively connected to the damper system and controls the damper system to place the booth from the non-cooling mode to the cooling mode in response to the input of currency into the vending unit.

20 Claims, 6 Drawing Sheets

AIR-CONDITIONED BOOTH WITH VENDING UNIT

FIELD OF THE INVENTION

The present invention relates to air-conditioned booths, and more particularly to an enclosed booth having an air conditioner for cooling the booth for a selected time period in response to the input of currency into a vending unit.

BACKGROUND OF THE INVENTION

An individual in a club may desire to be temporarily cooled-off and refreshed without having to leave the area. For example, after dancing in a club, a person may become uncomfortably warm and desire a cooler environment. Such individuals, however, may not wish to leave the club because the individual would miss out on activities occurring in the club.

The prior art does not provide an apparatus that can effectively be used in a club or bar environment. U.S. Pat. No. 2,243,570 to Morrison, and U.S. Pat. No. 2,963,881 to Starr disclose covers that can be placed over an individual with cooled air being blown into the covered space. These covers do not completely enclose an area or provide a self-contained unit. U.S. Pat. No. 2,247,028 to Kuntz discloses a telephone booth with the cooling apparatus located in a top unit disposed above the enclosed space. The telephone booth is not transparent and would not be effective in a club environment.

SUMMARY AND OBJECTS OF THE INVENTION

The present invention is designed to be used in a bar or club and entails an air-conditioned booth that can accommodate a small number of people in the club. The air-conditioned booth allows users to conveniently access an enclosed area having cooled air. The air-conditioned booth is positionable between a non-cooling mode where cooled air is directed outside of the booth and a cooling mode where cooled air is directed into the interior space of the booth. A vending unit is operatively connected to the booth and the booth is positionable from the non-cooling mode to the cooling mode by inserting coins or other currency into the vending unit.

Structurally, the booth includes a wall structure that extends between a platform and a top. The wall structure includes transparent side walls and encloses an interior space. The booth also includes an air conditioner for cooling air and a duct system connected to the air conditioner for directing the cooled air into the interior space of the booth. A damper system is positioned in the duct system and is positionable to place booth in either the cooling mode or the non-cooling mode.

The positioning of the damper system to place the booth in either the cooling mode or the non-cooling mode is controlled by a vending unit. The vending unit accepts currency and places booth in a cooling mode for a selective period of time in response to a person inputting coins or other currency into the vending unit. A user wishing to be cooled off in the booth inputs currency into the vending unit and enters the booth to be cooled off for a selected time period.

It is therefore an object of the present invention to provide an air-conditioned booth which is suitable for a bar or club environment.

Another object of the present invention is to provide a booth with transparent side walls so that a user remains in visual contact with the environment surrounding the booth.

Another object of the present invention is to provide an air-conditioned booth that is positionable from a non-cooling mode to a cooling mode in response to coins or other currency being inputted into a vending unit.

Other objects and advantages of the present invention will become apparent and obvious from a study of the following description and the accompanying drawings which are merely illustrative of such invention.

DETAILED DESCRIPTION OF THE INVENTION

Figure 1:
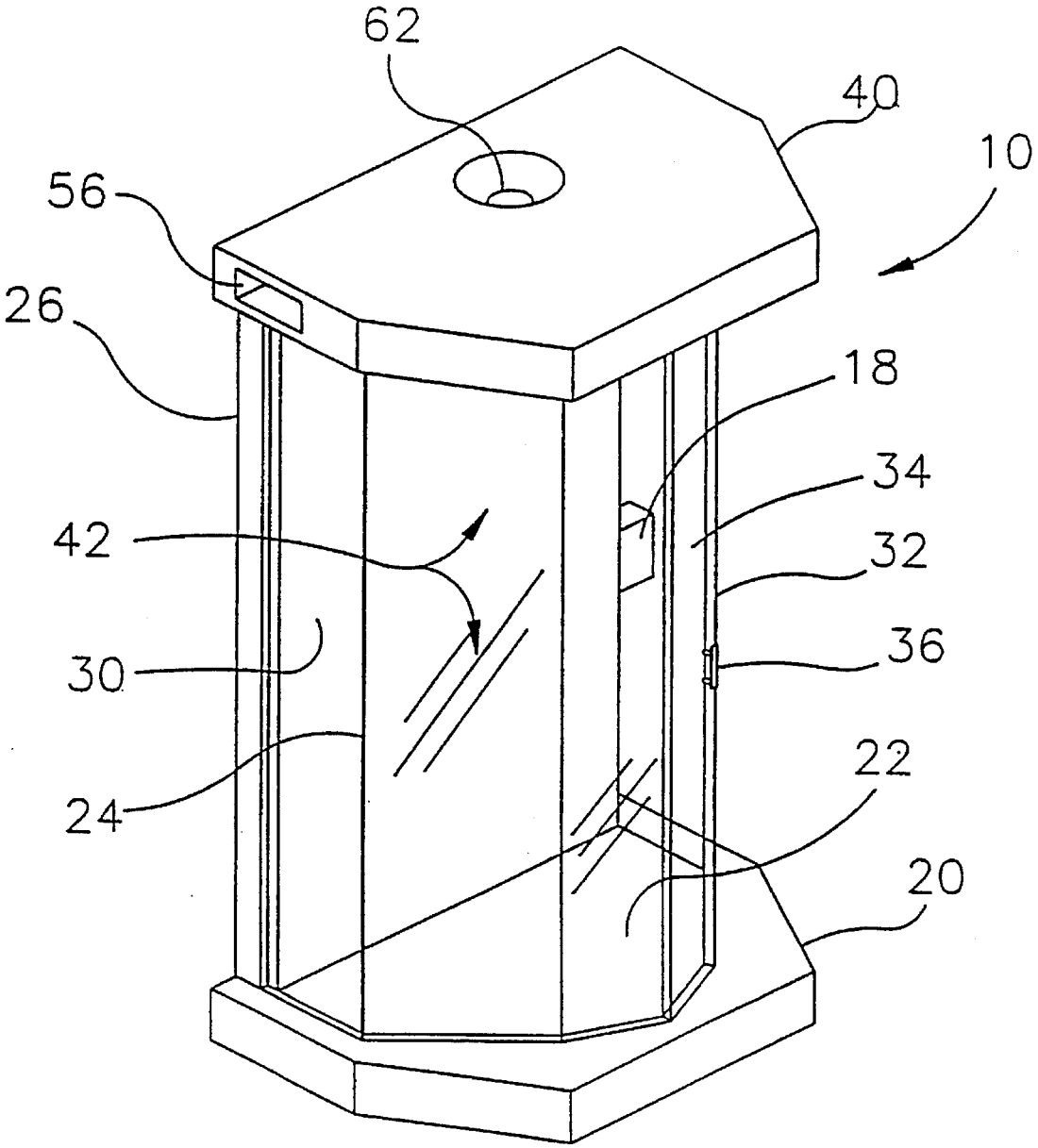
FIG. 1 is a front perspective view of the air-conditioned booth with the door closed.
Figure 2:
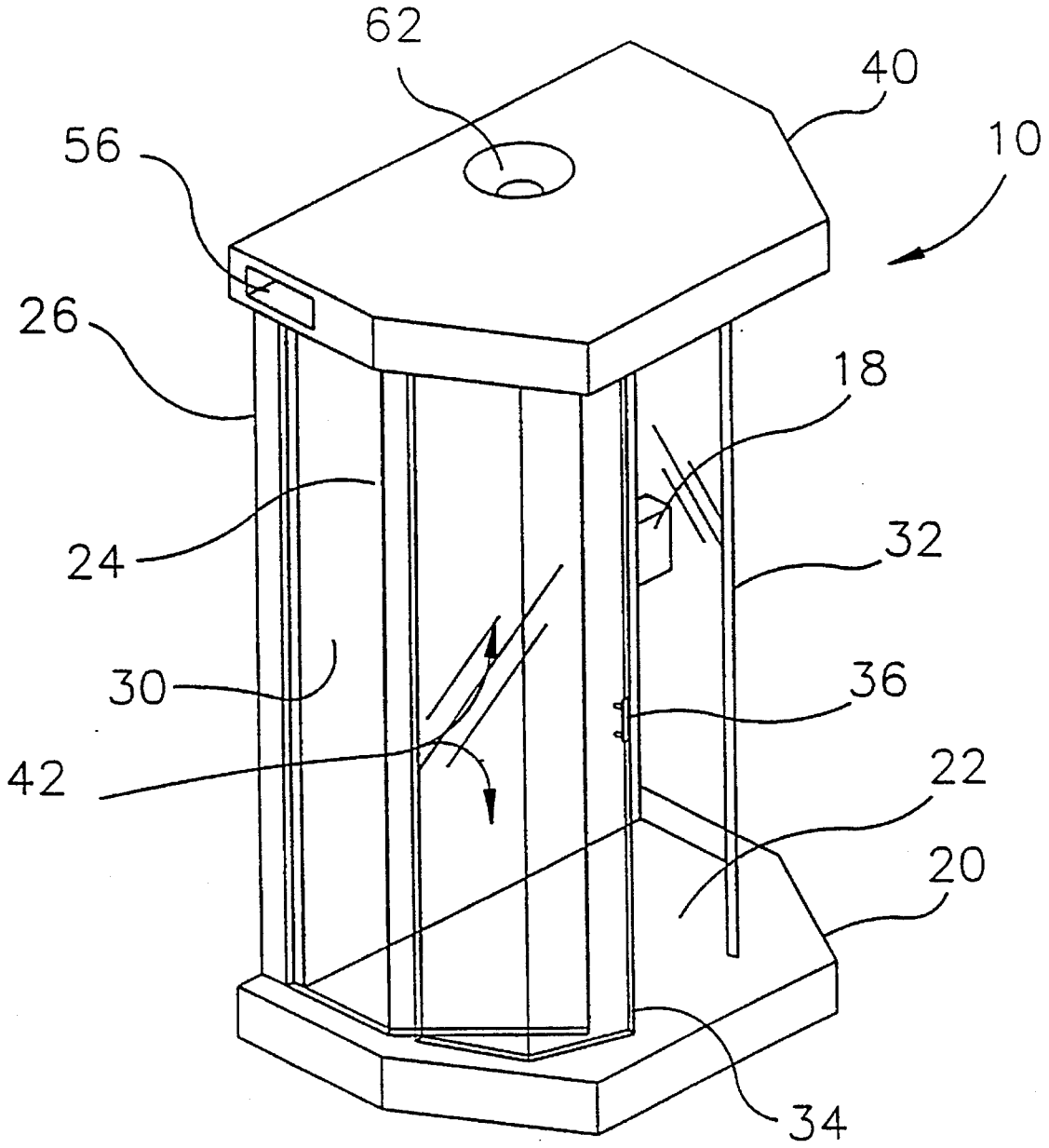
FIG. 2 is a front perspective view of the air-conditioned booth with the door open.
Figure 3:
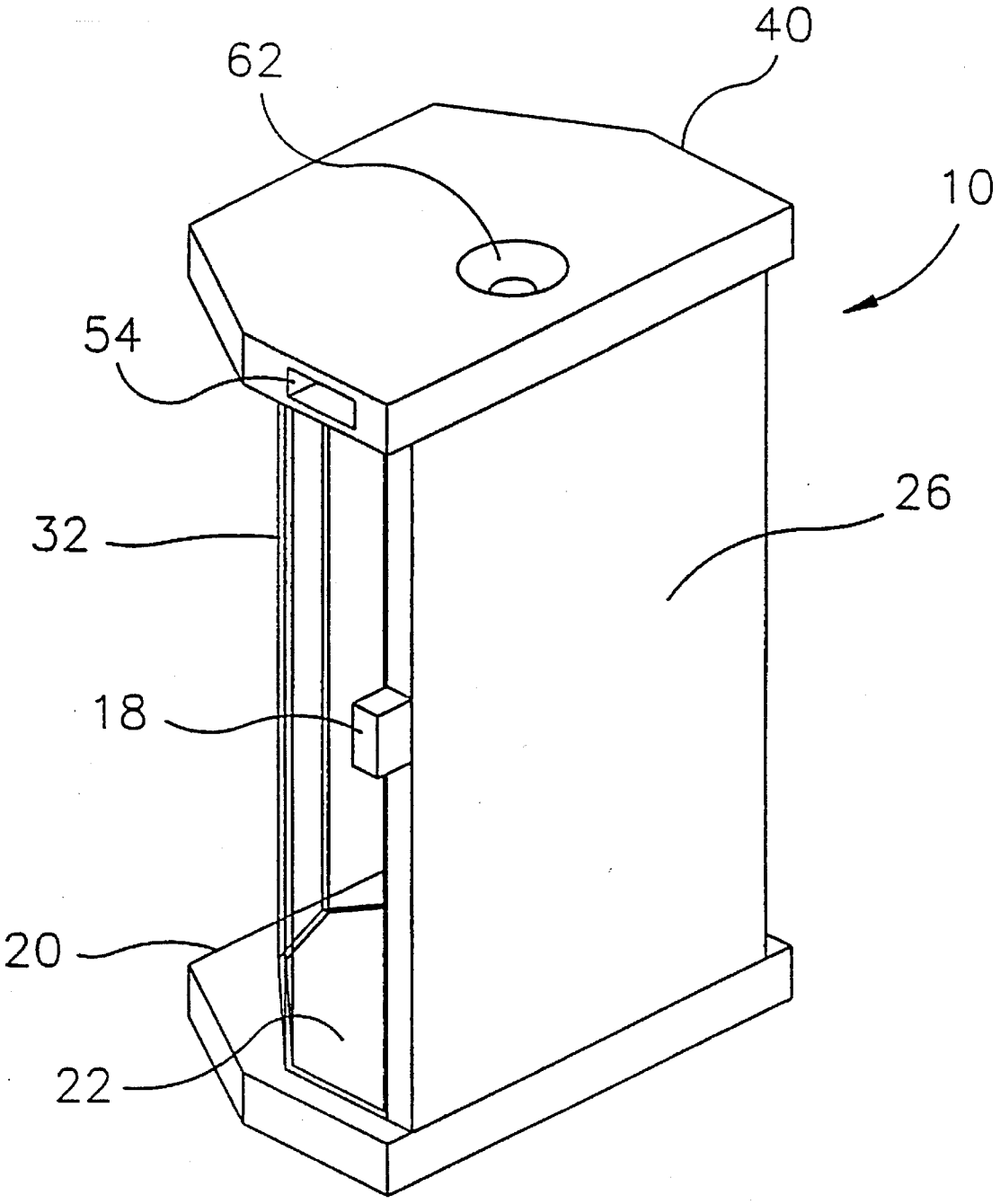
FIG. 3 is a back perspective view of the air-conditioned booth.

With further reference to the drawings, the air-conditioned booth of the present invention is shown therein and generally indicated by the numeral 10. Booth 10 is designed to be used in an environment that is uncomfortably warm. By entering the booth 10, a user can be cooled off and get temporary relief from the conditions outside the booth.

Booth 10 generally includes an air conditioner 12 for cooling air and a duct system 14 connected to air conditioner 12 for directing the cooled air into booth 10. A damper system 16 is positioned in duct system 14, and is positionable to place booth 10 in either a cooling mode or a non-cooling mode. The positioning of damper system 16 and the placement of booth 10 in either the cooling mode or the non-cooling mode is controlled by a vending unit 18. Vending unit 18 accepts currency and places booth 10 in a cooling mode for a selected period of time in response to a person inputting coins or other currency into the vending unit 18. Accordingly, a user wishing to be cooled-off in booth 10 inputs currency into vending unit 18 and then can enter booth 10 to be cooled-off for a selected time period.

As shown in FIG. 1, booth 10 includes a base unit 20 and a platform 22 supported thereon. In the preferred embodiment, platform 22 will be elevated approximately six to twelve inches off the surface. Surrounding platform 22 is a wall structure 24 which extends from base unit 20 to a top unit 40. Wall structure 24 includes a back wall 26, and side walls 30 and 32 extending from back wall 26. A door 34 connects side walls 30 and 32. Side walls 30 and 32 and door 34 are constructed of a sturdy, transparent material such as plastic, safety glass, or tempered glass that is capable of withstanding user contact. The transparent material can be either clear or tinted depending on the use of booth 10.

Door 34 includes a handle 36 that allows a user to freely open and close door 34. In the preferred embodiment, door 34 fits within a track (not shown) located in the base unit 20 and top unit 40. The door 34 is moved by laterally sliding the door within the door tracks.

Wall structure 24 encloses an interior space 42. In the preferred embodiment, interior space 42 is sized so that one or two people can comfortably stand within wall structure 24 and on platform 22. Air conditioner 12 provides cool air which is selectively directed into interior space 42 of booth 10.

Air conditioner 12 is a standard air conditioner that generally includes an evaporator 46, an evaporator fan 50, and a condensing unit 48. The evaporator fan 50 draws intake air into duct system 14 and moves the intake air across evaporator 46 to cool the intake air. Connected to evaporator 46 is condensing unit 48. The structure of condensing units are well known in the prior art and generally include a compressor, condensing coil, fan, and controls. The condensing unit 48 removes heat from refrigerant passing through condensing unit 48 and expels exhaust air from an exhaust vent 54. In the preferred embodiment, air conditioner 12 and duct system 14 are located in top unit 40.

Duct system 14 is operatively connected to air conditioner 12 to direct air into and out of booth 10. Duct system 14 includes both an exterior intake 56 and an interior intake 60. Exterior intake 56 connects the input of duct system 14 with the ambient air located outside of booth 10. Interior intake 60 is located within interior space 42 and connects the input of duct system 14 with the air located within interior space 42.

Duct system 14 also includes both an exterior output 62 and an interior output 64. Exterior output 62 connects the output of duct system 14 and air conditioner 12 to the ambient air located outside of booth 10. Interior output 64 is located within interior space 42 and connects the output of duct system 14 to the interior space 42 of booth 10.

Figure 4:
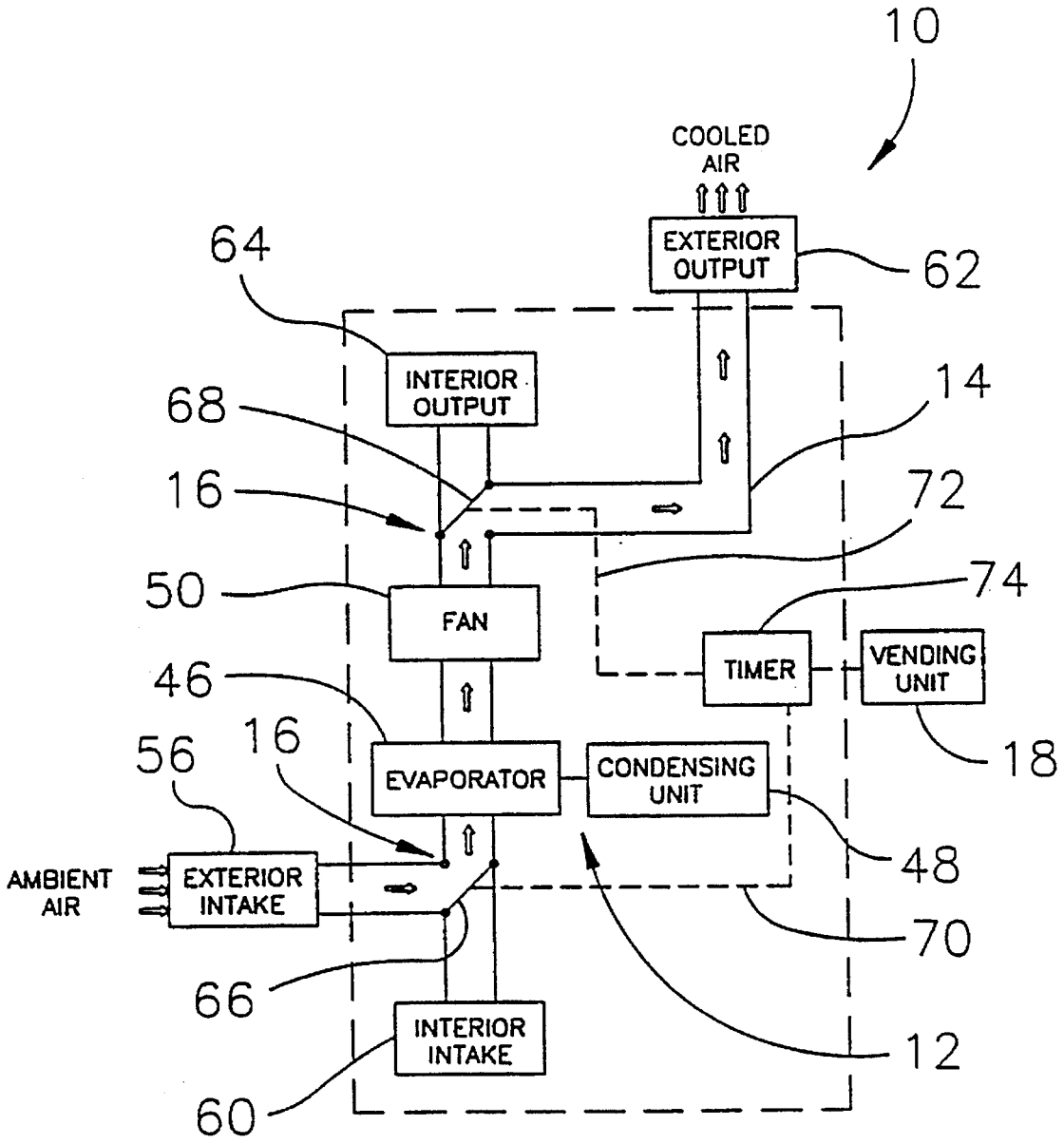
FIG. 4 is a schematic diagram of the air-conditioned booth in the non-cooling mode.

Damper system 16 controls the flow of air through duct system 14 and includes an intake damper 66 and an output damper 68. Intake damper 66 controls whether air is drawn into duct system 14 through exterior intake 56 or interior intake 60. As shown in FIG. 4, intake damper 66 has a first position where the intake damper 66 blocks the interior intake 60 to prevent air located within the interior space 42 of booth 10 from entering therethrough. When intake damper 66 is in the first position, the duct system 14 is coupled to exterior intake 56 and ambient air from outside of booth 10 is free to flow into duct system 14.

Figure 5:
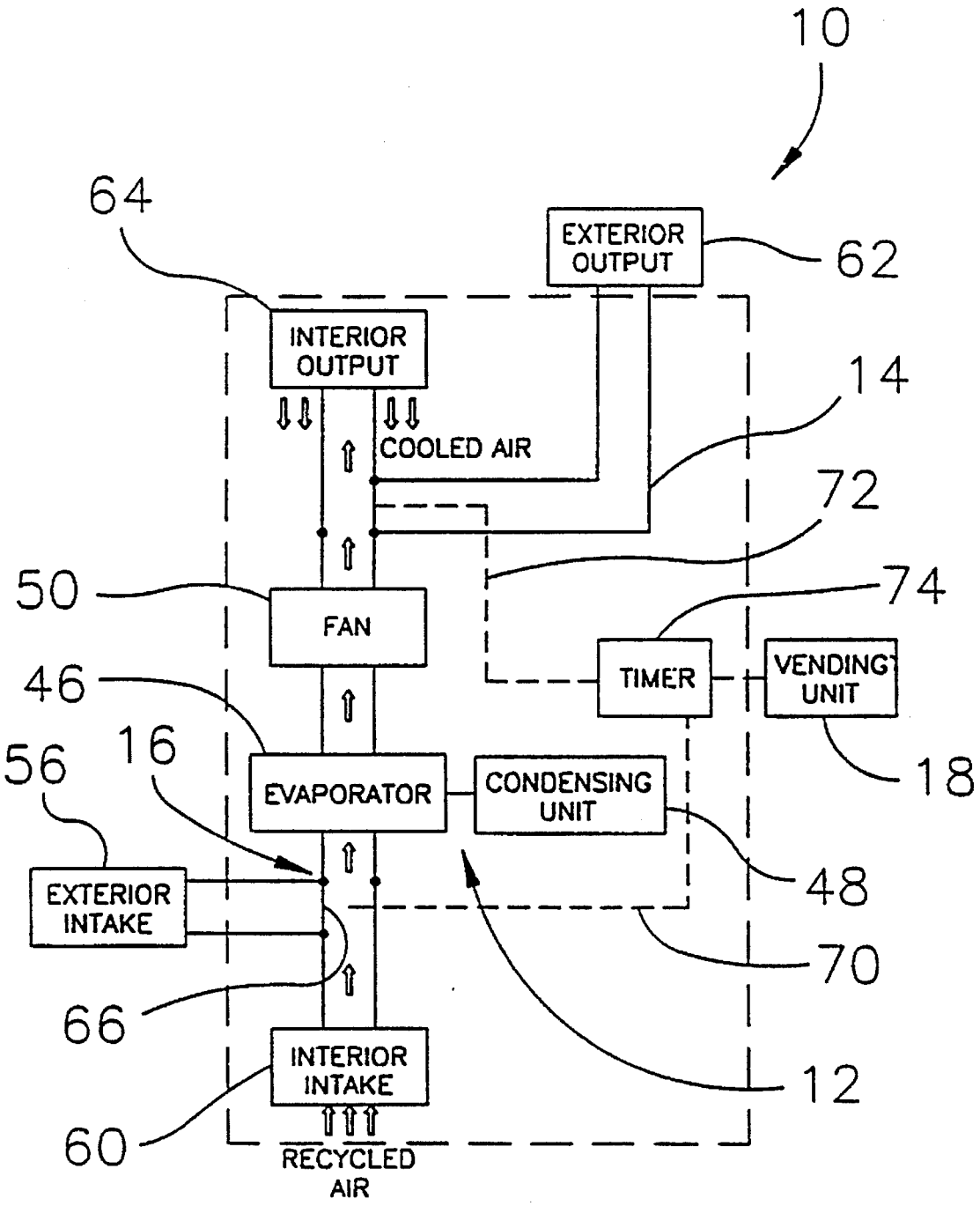
FIG. 5 is a schematic diagram of the air-conditioned booth in the cooling mode.

As shown in FIG. 5, intake damper 66 is also moveable to a second position where exterior intake 56 is blocked to prevent ambient air from entering through exterior intake 56 and into duct system 14. When intake damper 66 is in the second position, air within interior space 42 is free to flow into duct system 14 through interior intake 60.

Damper system 16 also includes an adjustable output damper 68 for selectively directing cooled air from air conditioner 12 to either the interior space 42 of booth 10 or outside of booth 10. As shown in FIG. 4, output damper 68 has a first position where it blocks interior output 64 to prevent cooled air from passing into interior space 42 of booth 10. When output damper 68 is in the first position, cooled air is directed outside of booth 10 through exterior output 62.

As shown in FIG. 5, output damper 68 also has a second position where it blocks exterior output 62 to prevent cooled air from passing therethrough. When output damper 68 is in the second position, cooled air is directed through interior output 64 and into the interior space 42 of booth 10.

Damper system 16 is designed to place booth 10 in either a cooling mode or a non-cooling mode. Booth 10 is shown in the non-cooling mode in FIG. 4. In the non-cooling mode, intake and output dampers 66 and 68 are positioned in their first positions such that ambient air is drawn through exterior intake 56 and passed over evaporator 46 so as to cool the ambient air. The cooled air is then directed out of exterior output 62 to the area outside of booth 10.

Booth 10 is shown in the cooling mode in FIG. 5. In the cooling mode, intake and output damper 66 and 68 are positioned in their second positions and air is drawn from inside the interior space 42 of booth 10 through interior intake 60 and passed over evaporator 46 so as to cool the air. The cooled air is then directed to the interior space 42 of booth 10 through interior output 64. Thus, in the cooling mode, air located within interior space 42 is recycled through air conditioner 12. Recycling air provides for more effective and efficient cooling of interior space 42 of booth 10.

Vending unit 18 controls the positioning of booth 10 between its cooling and non-cooling modes. Vending unit 18 is located on the wall structure 24 of booth 10 and is connected to the intake and output dampers 66 and 68 by conductors 70 and 72. Booth 10 is designed to be normally positioned in the non-cooling mode where damper system 16 causes ambient air to be cooled and outputted outside of booth 10.

Upon the insertion of coins or other currency into vending unit 18, vending unit 18 signals to the intake and output dampers 66 and 68 to move to their second positions such that the booth 10 is placed in the cooling mode where cooled air is directed into booth 10. The time period in which booth 10 is maintained in the cooling mode depends on the amount of currency placed in vending unit 18. A timer 74 is operatively connected between vending unit 18 and intake and output dampers 66 and 68 to control the time period that the booth 10 remains in the cooling mode for a given amount of currency inputted. At the end of a selected time period for maintaining the booth 10 in the cooling mode, intake and output dampers 66 and 68 move to their first positions to place booth 10 in the non-cooling mode.

In operation, booth 10 operates as follows. Air conditioner 12 is continuously run during the operation of booth 10. Continuously running air conditioner 12 allows cooled air to be immediately directed into the booth 10 when currency is inputted. This improves the system's performance by eliminating the need to repeatedly turn-off and turn-on air conditioner 12. Booth 10 normally assumes the non-cooling mode, as shown in FIG. 4, such that air cooled by the evaporator 46 is outputted to the area outside the booth 10. The exterior output 62 is located along top 40 of booth 10 so that people outside of booth 10 cannot stand in front of exterior output 62 and be directly cooled by the continuously running air conditioner 12.

A user wishing to use booth 10 inputs coins or bills into vending unit 18. Upon input of currency, vending unit 18 signals damper system 16 to adjust the positions of intake damper 66 and output damper 68 from their first positions to their second positions. This places booth 10 in the cooling mode shown in FIG. 5. The user can select the length of time that the booth 10 will be placed in the cooling mode by inputting varying amounts of money into vending unit 18. For example, inputting one dollar could place the cooling booth 10 in the cooling mode for one minute, while placing two dollars in the vending unit 18 could place booth 10 in the cooling mode for two minutes. An operator of booth 10 could adjust the time period for maintaining booth 10 in the cooling mode for a given amount of money by adjusting timer 74.

After input of currency into vending unit 18, the user steps onto base unit 20 and slides open door 34. The user then steps into the interior space 42 and onto platform 22. By closing door 34, interior space 42 of booth 10 is enclosed and is cooled rapidly by air conditioner 12. Because air conditioner 12 continuously runs during operation of the booth, the interior space 42 is rapidly and effectively cooled. In the preferred embodiment, booth 10 is designed to be cooled to a range of between 75° F.–85° F.

Once the user's allotted time expires, the intake damper 66 and output damper 68 are adjusted to their first positions to place booth 10 in the non-cooling mode. Accordingly, air conditioner 12 directs cooled air out of booth 10 instead of to the interior space 42 of booth 10. The user in booth 10 must exit booth 10 and place additional money in vending unit 18 to place booth 10 in the cooling mode.

Booth 10 provides an effective device to cool one or more persons located in a warm environment. Users of booth 10 are able to escape the warm outside environment and be cooled within booth 10 without having to leave the area. In addition, the transparent side walls 30 and transparent door 34 of booth 10 allow the user to remain in visual contact with the area surrounding booth 10. Because the cooling of booth 10 is controlled by vending unit 18, the operation of booth 10 can be controlled and commercially exploited. In addition, continuously running air conditioner 12 during operation of booth 10 eliminates the need to constantly cycle air conditioner 12 on and off. As with the preferred embodiment, vending unit 18 is operatively connected to the single damper and positions booth 10 from the non-cooling mode to the cooling mode in response to the input of currency into the vending unit 18.

Other embodiments of booth 10 are also included in the present invention. For example, the input of duct system 14 of booth 10 could be connected to an air conditioner located external of booth 10. In this alternate embodiment, damper system 16 would include a single damper positionable between first and second positions. When the single damper is positioned in the first position, cooled air is not directed into the interior space 42 of booth 10 and booth 10 is placed in the non-cooling mode. When the single damper is positioned in the second position, cooled air is directed into the interior space 42 of booth 10 and booth 10 is placed in the cooling mode. As with the preferred embodiment, vending unit 18 is operatively connected to the single damper and positions booth 10 from the non-cooling mode to the cooling mode in response to the input of currency into the vending unit 18. Electronic air cleaners or special filters can also be provided to clean intake air which is directed into booth 10.

Figure 6:
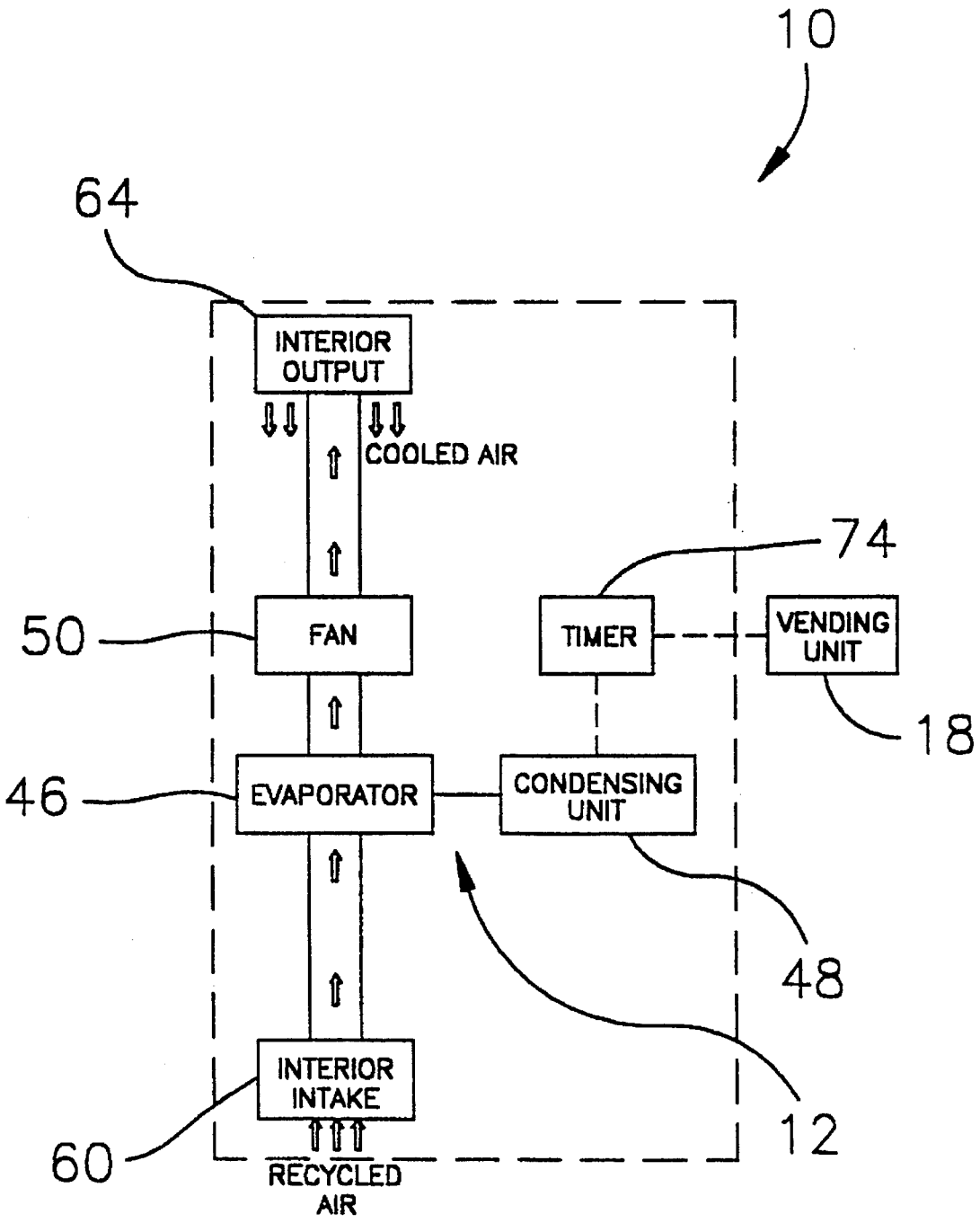
FIG. 6 is a schematic diagram of an alternate embodiment of the air-conditioned booth.

Another embodiment of cooling booth 10 is shown in FIG. 6. In this embodiment of cooling booth 10, vending unit 18 is connected directly to and controls the operation of air conditioner 12. The air conditioner 12 is normally positioned at a non-cooling setting where air conditioner 12 is turned off so that cooled air is not produced. When the air conditioner 12 is turned off, no cooled air is produced to be inputted into booth 10 and booth 10 is disposed in a non-cooling mode. The air conditioner 12 is positioned at a cooling setting where air conditioner 12 is turned on to produce cooled air by inserting currency into vending unit 18. Inserting currency into vending unit 18 turns on air conditioner 12 for a selected period of time. Turning on the air conditioner 12 causes cooled air to be directed into booth 10 through duct system 14 and results in booth 10 being placed in a cooling mode. In this alternative embodiment, booth 10 could be designed such that the non-cooling setting and the cooling setting of air conditioner 12 correspond to a low cooled air output by air conditioner 12 and a high cooled air output by air conditioner 12, respectively.

In the alternative embodiment shown in FIG. 6, booth 10 is disposed between the non-cooling mode and cooling mode by directly turning off and turning on the air conditioner 12. Accordingly, a damper system 16 for selectively blocking duct system 14, as described for the preferred embodiment of booth 10, is not required in this alternative embodiment. The air conditioner 12 of this embodiment can be mounted in and as a part of booth 10 or located external of booth 10.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An air-conditioned booth, comprising:

(a) a base unit;

(b) a platform connected to the base unit for a person to stand thereon;

(c) a wall structure extending upwardly from the platform and enclosing an interior space;

(d) a top unit attached to the wall structure such that the wall structure extends between the base unit and the top unit;

(e) a self-contained air conditioner disposed in the booth for cooling air;

(f) a duct system connected to the air conditioner for directing cooled air into the interior space of the booth;

(g) a damper system operatively connected with the duct system, the damper system having a first position where the cooled air is directed to ambient air outs of the booth through an exterior output so as to place the booth in a non-cooling mode and a second position where the cooled air from the air conditioner is directed into the interior space through an interior output so as to place the booth in a cooling mode; and (h) a vending unit operatively connected to the air conditioner, wherein the damper system is positioned from the first position to the second position for a selected time period in response to currency being inputted into the vending unit.

2. The air-conditioned booth of claim 1 wherein the duct system includes an interior intake and an exterior intake, and wherein the damper system includes an intake damper having a first position for opening the exterior intake to the duct system such that ambient air is drawn into the duct system and a second position for opening the interior intake to the duct system such that interior air located in the interior space is drawn into the duct system, wherein the intake damper is positioned in the first position when the booth is in the non-cooling mode and the intake damper is positioned in the second position when the booth is in the cooling mode.

3. The air-conditioned booth of claim 2 wherein the duct system includes an exterior output and an interior output, wherein the damper system includes an output damper having a first position for directing cooled air to an area outside of booth 10 through the exterior output and having a second position for directing cooled air into the interior space of the booth through the interior output, and wherein the output damper is positioned in the first position when the booth is in the non-cooling mode and the output damper is positioned in the second position when the booth is in the cooling mode.

4. The air-conditioned booth of claim 1 wherein the duct system includes an interior intake disposed in the interior space of the booth for recycling cooled air in the interior space when the damper system is in the cooling mode.

5. The air-conditioned booth of claim 1 wherein the vending unit is operatively connected to an adjustable timer, and wherein the timer controls the time period that cooled air is directed into the interior space for a predetermined amount of currency inputted into the vending unit.

6. The air-conditioned booth of claim 3 wherein the exterior output is disposed in the top unit.

7. The air-conditioned booth of claim 1 wherein the wall structure includes transparent side walls and a transparent door.

8. An air-conditioned booth used in an entertainment club for providing a cooled environment in the club, comprising:

(a) a base unit;

(b) a platform connected to the base unit for a person to stand thereon;

(c) a wall structure extending upwardly from the platform and enclosing an interior space;

(d) a top unit attached to the wall structure such that the wall structure extends between the base unit and the top unit;

(e) an interior output coupled to the interior space of the booth and connectable to an air conditioner;

(f) a damper operatively connected to the interior output vent and moveable between a first position where the damper blocks cooled air from passing into the interior space of the booth through the interior output so as to place the booth in a non-cooling mode and a second position where the cooled air is directed into the interior space through the interior output so as to place the booth in a cooling mode;

(g) a vending unit operatively connected to the damper, wherein the damper is moved from the first position to the second position for a selected time period in response to a predetermined amount of currency being inputted into the vending unit.

9. The air-conditioned booth of claim 8 further including an exterior output, and wherein the cooled air is directed by the damper to the exterior output when the booth is in the non-cooling mode.

10. The air-conditioned booth of claim 9 wherein the exterior output is disposed in the top unit.

11. The air-conditioned booth of claim 8 wherein the vending unit is operatively connected to an adjustable timer, and wherein the timer controls the time period that cooled air is directed into the interior space of the booth for a predetermined currency amount deposited into the vending unit.

12. The air-conditioned booth of claim 8 wherein the wall structure includes transparent side walls and a transparent door.

13. An air-conditioned booth, comprising:

a) a base platform;

b) a wall structure extending upwardly from the base platform and enclosing an interior space;

c) a top attached to the wall structure such that the wall structure extends between the base platform and the top;

d) an air conditioner having an interior output coupled to the interior space of the booth; and e) a vending unit operatively connected to the air conditioner for actuating the air conditioner between a non-cooling setting, which places the booth in a non-cooling mode, and a cooling setting, which places the booth in a cooling mode, wherein the air conditioner is actuated from the non-cooling setting to the cooling setting in response to currency being inputted into the vending unit.

14. The air-conditioned booth of claim 13, further comprising a duct system for carrying cooled air from the air conditioner into the interior space of the booth.

15. The air-conditioned booth of claim 13, wherein the interior space of the booth is sized to accommodate at least one person.

16. The air-conditioned booth of claim 13, further comprising a timer operatively connected between the vending unit and the air conditioner to control the time period that the booth remains in the cooling mode for a given amount of currency inputted into the vending unit.

17. The air-conditioned booth of claim 16, wherein the timer is adjustable.

18. An air-conditioned booth, comprising:

(a) a base unit;

(b) a platform connected to the base unit for a person to stand thereon;

(c) a wall structure extending upwardly from the platform and enclosing an interior space;

(d) a top unit attached to the wall structure such that the wall structure extends between the base unit and the top unit;

(e) a duct system leading into the interior space of the booth;

(f) an air conditioner connected to the duct system, wherein the duct system directs cooled air from the air conditioner into the interior space of the booth; and (g) a vending unit operatively connected to the air conditioner for actuating the air conditioner between a non-cooling setting which places the booth in a non-cooling mode and a cooling setting which places the booth in a cooling mode, wherein the air conditioner is actuated from the non-cooling setting to the cooling setting for a selected time period in response to currency being inputted into the vending unit.

19. The air conditioned booth of claim 18 wherein the air conditioner is turned off when positioned at the non-cooling setting.

20. The air conditioned booth of claim 18 wherein the air conditioner is a self-contained air conditioner disposed in and as a part of the booth.

* * * * *